United States Patent [19]

Sestero

[11] Patent Number: 4,664,010

[45] Date of Patent: May 12, 1987

[54] METHOD AND DEVICE FOR TRANSFORMING MUSICAL NOTES

[75] Inventor: Arrigo Sestero, Rome, Italy

[73] Assignee: Casio Computer Co., Ltd., Tokyo, Japan

[21] Appl. No.: 670,338

[22] Filed: Nov. 9, 1984

[30] Foreign Application Priority Data

Nov. 18, 1983 [IT] Italy ..... 49360 A/83

[51] Int. Cl.[4] ..... G10H 1/00

[52] U.S. Cl. ..... 84/1.01; 84/1.03; 84/473; 84/474; 84/445

[58] Field of Search ..... 84/1.01, 1.03, 445, 84/453, 473, 474

[56] References Cited

U.S. PATENT DOCUMENTS

| | | | |
|---|---|---|---|
| 2,564,616 | 8/1951 | Telasco | 84/473 |
| 3,745,872 | 7/1973 | Hill | 84/473 |
| 3,824,325 | 7/1974 | Obayashi et al. | 84/445 |
| 3,877,337 | 4/1975 | Obayashi et al. | 84/445 |
| 3,877,338 | 4/1975 | David | 84/453 |
| 4,048,893 | 9/1977 | Coles | 84/445 |

OTHER PUBLICATIONS

Harvard Concise Dictionary of Music, 1978, pp. 515–516.

*Primary Examiner*—Russell E. Adams

*Attorney, Agent, or Firm*—Frishauf, Holtz, Goodman & Woodward

[57] ABSTRACT

A method of and a device for transforming the musical notes of a piece of music into different notes to obtain a new piece of music. The notes constituting the original piece of music are stored in an original music memory. These notes are then transformed into other notes in accordance with predetermined rules stored in a transforming means and the transformed notes are thereafter stored in a transformed music memory.

9 Claims, 2 Drawing Figures

METHOD AND DEVICE FOR TRANSFORMING MUSICAL NOTES

BACKGROUND OF THE INVENTION

1. Field of the Invention

This invention relates to a method and device for transforming musical notes, more particularly to a method and device for transforming the musical notes constituting the melody and chords of a piece of music so as to obtain a new piece of music that is totally different from the first piece of music but which preserves a high degree of aesthetic value.

2. Description of the Prior Art

A number of different methods have been proposed for transforming sequences of notes into other sequences of notes in accordance with fixed rules. For example, A. Schonberg proposed certain rules of composition as the basis for the "dodecaphonic" genre of music. Although musical composition procedures of this kind have sometimes led to results that are interesting for their high degree of intellectual sophistication, they have not been able to consistently produce musical pieces capable of evoking an emotional response from lay audiences.

SUMMARY OF THE INVENTION

An object of the present invention is to provide a method of transforming musical notes which is capable of converting a given piece of music into an entirely different piece of music having high aesthetic value.

Another object of this invention is to provide a device for carrying out this method.

In the method for transforming musical notes in accordance with this invention, the notes of piece of music are first memorized in an original music memory means and then are transformed into other musical notes in accordance with predetermined rules stored in a transforming means. Finally, the transformed notes can be stored in a transformed music memory. The device for carrying out this method comprises at least an original music memory means for storing the notes of a piece of music and a musical note transforming means which transforms the notes stored in said memory in accordance with predetermined rules.

DESCRIPTION OF THE PREFERRED EMBODIMENTS

Figure 1:
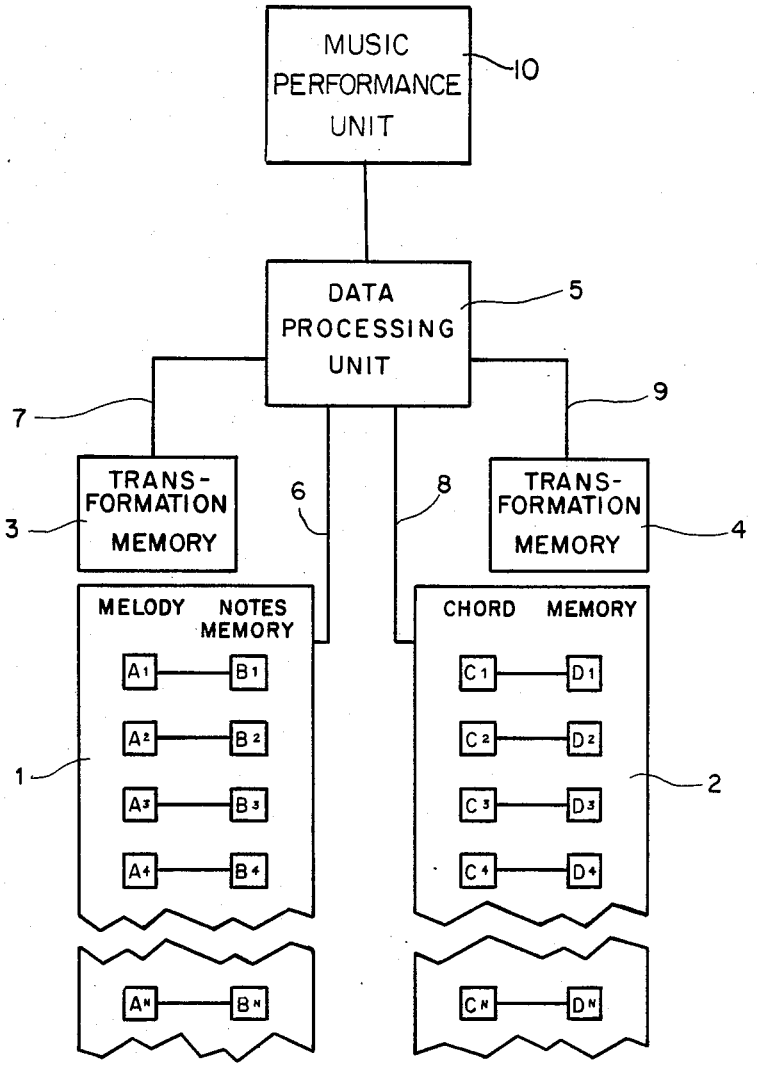
FIG. 1 is a block diagram showing the general concept of the musical note transforming device of the present invention.

Among all conceivable rules for transformation of musical notes, the transformation rule employed in the present invention is unique in that it is based on a specific formal symmetrical property that can be shown to exist in tonal music, the most widely appreciated of all musical genre.

The formal symmetry referred to above has a geometrical counterpart in the distribution of the white and black keys of the standard keyboard, whereby the black keys are grouped in alternate sets of two and three black keys close together, the sets of two black keys being centered on the white keys for Re, and the sets of three black keys being centered on the black keys for Sol # (=La b).

Hence, all Re keys and all Sol# (=La b) keys are points of mirror symmetry for the keyboard. Moreover, they are the only keys possessing this property.

Let us first consider the symmetry with respect to the Re keys. The correspondence between the respective notes and their symmetrical counterparts is easily seen to be as shown in the following Table 1. (For the moment, only notes associated with the white keys are considered.)

TABLE 1

| | | | | | | | |
|---|---|---|---|---|---|---|---|
| Original note | Do | Re | Mi | Fa | Sol | La | Si |
| Counterpart | Mi | Re | Do | Si | La | Sol | Fa |

On the other hand, it can be easily verified that the symmetry with respect to the Sol# (=La b) keys results in the same correspondence as shown in Table 1 among the white keys, provided that notes differing by one full octave are considered to be idential (namely, provided one operates "modulo the octave"). Hence, the correspondence defined by Table 1 is the only correspondence among notes implied by the above-mentioned symmetrical property of the keyboard. Thus transformation of notes to their counterparts results in a "duality" in the sense that if it is carried out twice, it reproduces the original notes. Finally, considering the black keys, it is easily verified that the aforesaid symmetrical relation also results in the same duality relation if, in addition to the transformation rule implied by Table 1, there is introduced another rule requiring the symbol for "sharp" (#) to be transformed into the symbol for "flat" (b) and vice versa.

The first line of the original notes in Table 1 is obviously the scale of Do major. On the other hand, the corresponding sequence of the counterpart notes does not at a glance look equally familiar. However, examining the three notes that constitute the tonic chord in the tonality of Do major, namely the notes Do, Mi and Sol, it is seen that their counterparts are respectively the notes Mi, Do and La, namely the notes that constitute the tonic chord of the tonality of La minor (although in reverse order). This is a very interesting fact since, in view of the importance of the tonic chord in tonal music, it implies that the correspondence should be interpreted as duality between the major mode and the minor mode, the second line in Table 1 being simply the (natural) La minor scale ordered by descending motion from its "dominant" fifth grade (namely, from the note Mi). Actually, the usual method of ordering the scale by ascending motion starting from the tonic is nothing but a convention. If, for example, this convention is accepted for major scale, then by going through the duality transformation a different convention for the ordering of the (natural) minor scale would be derived. Namely, the sequence given by the second line in Table 1 would be obtained. Here, it is interesting to note that the latter convention is akin to the Hellenic custom of ordering the scales by descending motion, with the most important note—the so-colled "μεοη", corresponding in a way to our tonic note—being placed in an intermediate position within the scale rather than at its beginning. As a matter of fact, in books dealing with ancient music the sequence of notes given by the second line of Table 1 is usually associated with the so-called "Dorian mode" of the ancient Greeks.

Going back to the modern tonal system of music (with all the conventions accepted therein), it is interesting to note that the previously considered duality correspondence brings about an intriguing exchange of roles between the various notes (or "grades") of the scale, as indicated by the following table:

TABLE 2

| Grades of the major scale | Grades of the (natural) minor scale |
|---|---|
| Tonic | Dominant |
| Supratonic | Subdominant |
| Mediant | Mediant |
| Subdominant | Supratonic |
| Dominant | Tonic |
| Supradominant | Subtonic |
| Leading-to-tonic | Leading-to-dominant |

As for the chords (namely, simultaneous combinations of notes), it can be prescribed that they be transformed note by note (sequential ordering in a set of notes which sound simultaneously being obviously inessential). If, for the sake of simplicity, the discussion is restricted to three-note chords, it is noted that such chords transform as listed in the following Table 3, where the note which is the chord root is labeled by the name of its role in the scale, and the chord quality is indicated by the symbols M (major), m (minor) and d (diminished):

TABLE 3

| Three-note chords of the major mode | Three-note chords of the (natural) minor mode |
|---|---|
| Tonic (M) | Tonic (m) |
| Supratonic (m) | Subtonic (M) |
| Mediant (m) | Leading-to-dominant (M) |
| Subdominant (M) | Dominant (m) |
| Dominant (m) | Subdominant (m) |
| Supradominant (m) | Mediant (M) |
| Leading-to-tonic (d) | Supratonic (d) |

Although there are many subtle factors which affect the way a person perceives a piece of music, it is safe to say that in the case of a piece of music obtained by transforming the notes of an original piece of music in accordance with the rules discussed above, it is the exchange of note roles in the scale, of chord roots, and of chord quality that constitute the basis of the feeling of "entirely different and new" that the hearing of the transformed piece of music generally produces. On the other hand, the conservation of frequency ratios (albeit reversed) between the various notes of the melody and of the harmony can be considered to be the reason for the preservation in the transformed piece of an emotional appeal which if often not less captivating than the original theme. At any rate, when the notes of a piece of music are transformed in accordance with method of this invention on the basis of the above-mentioned rules, it is always a very difficult task, even for a person highly familiar with the principles of music, to guess the original piece of music no matter how familiar it may be.

Now with reference to the above theoretical considerations on the subject of duality in tonal music, the present invention will be described in further detail with reference to specific procedures of the method for transforming musical notes and to specific embodiments of the device for carrying out this method.

One embodiment of the device for transforming musical notes in accordance with this invention comprises a first original music memory means for storing the notes of the melody which is to be transformed; a second original music memory means for storing the notes of the chords associated with said melody; a first transforming memory means which stores information defining the correspondence between the notes of the original melody and the notes to which they are to be transformed; a second transforming memory means which stores information defining the relationship between the notes of the chords of the original music and the notes to which they are to be transformed; a logical processing unit programmed to transform the notes of the melody and chords of the original music in accordance with a prescribed procedure; a first transformed music memory means for storing the transformed notes of the melody; and a second transformed music memory means for storing the notes of the chords.

In this embodiment, the first transforming memory means is so arranged as to associate every key of the standard keyboard with its mirror-symmetric counterpart with respect to a Re key or a Sol ♯ (=La b) key, as the case may be, so that the basic sequence of notes Do, Re, Mi, Fa, Sol, La, Si is transformed into the counterpart sequence Mi, Re, Do, Si, La, Sol, Fa and the symbol "sharp" (♯) is transformed into the symbol "flat" (b), and vice versa. The second transforming memory means for chord transformation is arranged to associate each note of a chord with its mirror-symmetric counterpart in the same manner as just described in connection with the melody notes. The logical processing unit is operatively connected with the first and second original music memory means and with the first and second transforming memory means so that it can sequentially read out the contents of the first (second) original music memory means, carry out the transformation defined by the rules contained in the first (second) transforming memory means, and then store the results of the transformation in the first (second) transformed music memory means. If desired for reducing cost, the first (second) original music memory means can double as the first (second) transformed music memory means. In this case, the original piece of music is lost in the process of producing the transformed music, but it can be easily retrieved by carrying out the transformation once again in view of the duality property of the transformation.

The method of transforming musical notes in accordance with this invention comprises the steps of memorizing rules for transforming melody notes wherein every key of the standard keyboard is associated with a mirror-symmetric counterpart with respect to a Re key or a Sol ♯ (=La b) key, as the case may be, in such manner that the basic sequence of notes Do, Re, Mi, Fa, Sol, La, Si is associated with the sequence of counterpart notes Mi, Re, Do, Si, La, Sol, Fa and the symbol "sharp" (#) is associated with the counterpart symbol (b); memorizing rules for transforming chord notes wherein each note of a chord is associated with a counterpart note in the same manner as described in connection with the melody notes; memorizing the notes of the melody which is to be transformed; memorizing the notes of the associated chords; sequentially transforming the melody and chord notes according to the prescribed rules of transformation; and storing the result of the transformation in a form suitable for playing the transformed music (i.e. through a music performance unit 10 shown in FIG. 1) or for other purposes.

Figure 2:
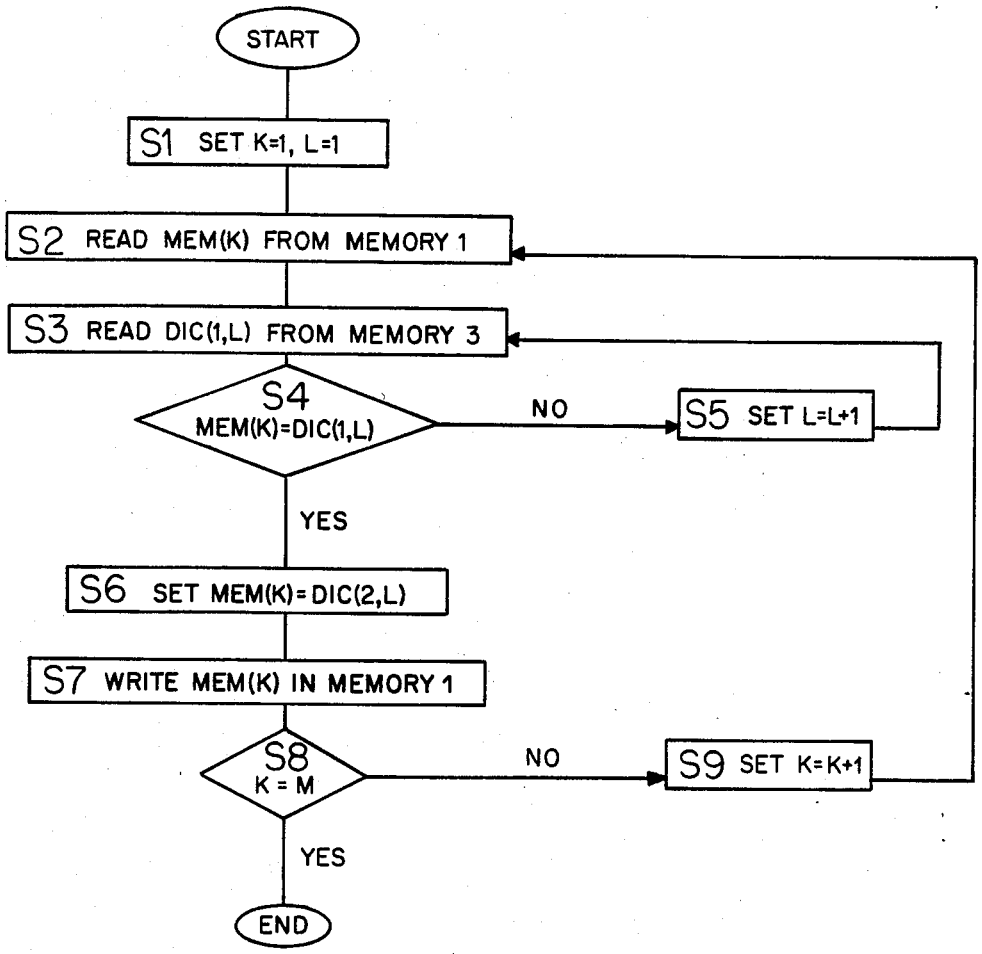
FIG. 2 is a flow chart showing a procedure for transforming notes in accordance with this invention.

An embodiment of the invention will now be described more concretely with respect to the drawings. In FIG. 1, which shows a block diagram of a device for transforming musical notes in accordance with invention, the reference numerals 1 and 2 denote a melody notes memory and a chord notes memory, respectively. Both are of the RAM type. The user of the device stores the notes of the melody which is to be transformed. This is done by first storing the pitch A1 and the duration B1 of the first note, the pitch A2 and the duration B2 of the second note, etc. In memory 2 the user stores the accompaniment chords, namely the identification tag C1 and duration D1 of the first chord, the identification tag C2; and the duration D2 of the second chord, etc. Denoted by the reference numerals 3 and 4 are transforming memories defining the relationship between the notes of the original music and the transformed music for the melody notes and chord notes, respectively. These are ROM memories. By the reference numeral 5 is denoted a data processing unit suitably programmed with ROM-coded instructions for carrying out the transformation procedure. A flow chart showing the operation of the ROM-coded program for transformation of the melody notes is shown in FIG. 2. When this program is run with reference to the pair of memories 1 and 3, the sequence of melody notes, namely MEM (K) with $K=1, \ldots M$, is transformed in accordance with the rules of transformation defined by the $2 \times N$ array consisting of DIC (I, L) with $I=1, 2$ and $L=1, 2 \ldots N$. The same program, run with reference to the pair of memories 2 and 4, effects transformation of the accompaniment chords.

The operation of this device will now be explained. Input of a start instruction activated the transformation procedure for the melody (involving the blocks 1, 3 and 5 in FIG. 1) and the chords (involving the blocks 2, 4 and 5). The data processing unit 5 sequentially reads out the notes A1, A2. . . . from the memory 1 through line 6 and for each of these notes it searches through the dictionary stored in the memory 3, to which it is connected via line 7, until it finds the corresponding counterpart note (A1′, A2′, . . . ). When the counterpart note is found, it is stored in the memory 1 via the line 6 in place of the original note.

This operation of the device will now be explained with reference to the flow chart shown in FIG. 2. First in step S1 the variables K, L are set at 1. Then in S2 the Kth note is read from the memory 1 and set as MEM (k). In step S3 the (1, L)th note is read from memory 3 and set as DIC (1, L). In step S4 the content of MEM (k) is compared with that of DIC (1, L) and if they do not coincide, the procedure advances to step S5, wherein L is increased by 1 and the program returns to S3. When coincidence is obtained in S4, the program advances to step S6 wherein the (2, L)th note, namely the counterpart note, in memory 3 is set for MEM (k). In the following step S7 the counterpart note set as MEM (k) is written into the memory 1. Then in step S8 it is determined whether all of the notes stored in memory 1 have been read out, and if No, K is increased by 1 in step S9 and the program reverts to S2. If YES, the transformation procedure is discontinued.

After this operation is completed for the memories 1 and 3, it is repeated for the memories 2 and 4 via the lines 8 and 9. As a result the sequence of chords C1, C2, . . . is transformed into the counterpart sequence C1′, C2′, . . . which is then stored in the memory 2 in place of the original sequence. The chord durations B1, B2, . . . and chord durations D1, D2, . . . are left unchanged by the transformation procedure. Upon the completion of the above-described procedures, therefore, the RAM memories 1 and 2 contain a musical piece which is the counterpart of whatever musical piece was originally stored in them. The transformed music can be read out of the memories 1 and 2 by well-known means and used to play the transformed musical piece (i.e., through the music performance means 10 shown in FIG. 1) or for other purposes. In this embodiment, though the original piece of music is lost in the transformation procedure, it can easily be recreated simply by going through the transformation process once more.

The device just described enables transformation of any musical scores (within the limits of the available RAM capacity), with intriguing and often surprising results. Various modifications of the invention described herein can be made without departing from the spirit of the invention. It is therefore to be understood that within the scope of the appended claims this invention may be practiced otherwise than as specifically described herein.

I claim:

1. A device for transforming musical notes, comprising:

a first original music memory means for storing the notes of the melody of a piece of music, a second original music memory means for storing the notes of the chords of the accompanying harmony of the piece of music, a first transforming memory means for storing rules for transforming the notes stored in said first original music memory means, a second transforming memory means for storing rules for transforming the notes stored in said second original music memory means, a logical processing unit including:

means for reading first notes from said first original music memory means; and means for automatically transforming, about one of two respective fixed predetermined axes of transformation, said first notes to other notes in accordance with the rules for transforming notes stored in said first transforming memory means, and means for reading second notes from said second original music memory means; and means for automatically transforming, about the other of said two respective fixed predetermined axes of transformation, said second notes to other notes in accordance with the rules for transforming notes stored in said second transforming memory means, wherein the rules stored in said first transforming memory means and the rules stored in said second transforming memory means are such that every key of the standard keyboard is associated with its mirror-symmetric counterpart with respect to one of a Re key and a Sol# (=La b) key, said Re and Sol# keys being said fixed predetermined axes of transformation, whereby the basic sequence of notes Do, Re, Mi, Fa, Sol, La, Si is transformed into the counterpart sequence Mi, Re, Do, Si, La, Sol, Fa, and the symbol "sharp" (#) is transformed into the symbol "flat" (b) and vice versa;

a first transformed music memory means for storing the melody notes transformed by said logical processing unit, a second transformed music memory means for storing the chord notes transformed by said logical processing unit, and music performing means for performing said transformed notes stored in said first and second transformed music memory means.

2. A device for transforming musical notes in accordance with claim 1 wherein said first original music memory means and said first transformed music memory means are the same memory block.

3. A device for transforming musical notes in accordance with claim 1 wherein said first original music memory means and said first transformed music memory means are separate memory blocks.

4. A device for transforming musical notes in accordance with claim 1 wherein said second original music memory means and said second transformed music memory means are the same memory block.

5. A device for transforming musical notes in accordance with claim 1 wherein said second original music memory means and said second transformed music memory means are separate memory blocks.

6. A device for transforming musical notes in accordance with claim 1 wherein said first and second original music memory means and said first and second transformed music memory means comprises read/-write memories.

7. A device for transforming musical notes in accordance with claim 1 wherein said first transforming memory means and said second transforming memory means are the same memory block.

8. A device for transforming musical notes in accordance with claim 1 wherein said first transforming memory means and said second transforming memory means are separate memory blocks.

9. A device for transforming musical notes in accordance with claim 1 wherein said logical processing unit comprises said music performing means for performing said transformed notes stored in said first transformed music memory means and in said second transformed music memory means.

* * * * *